US006481174B1

(12) United States Patent
Münger et al.

(10) Patent No.: US 6,481,174 B1
(45) Date of Patent: Nov. 19, 2002

(54) AUXILIARY TOOL FOR FILLING A BORE WITH A MORTAR MASS

(75) Inventors: Fritz Münger, Buchs (CH); Manfred Hartmann, Nenzing (AT); Oliver Wolff, Leinfelden-Echterdingen (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/521,689

(22) Filed: Mar. 9, 2000

(30) Foreign Application Priority Data

Mar. 13, 1999 (DE) ..... 199 11 259

(51) Int. Cl.[7] ..... E02D 37/00

(52) U.S. Cl. ..... 52/514.5; 405/269; 52/741.41; 52/742.13; 52/749.1

(58) Field of Search ..... 52/514.5, 741.4, 52/741.41, 742.1, 742.13, 742.14, 742.15, 742.16, 749.13; 264/36, 35; 405/269

(56) References Cited

U.S. PATENT DOCUMENTS 4,260,295 A 4/1981 Vestlund
5,257,486 A * 11/1993 Holmwall ..... 52/514.5
6,226,948 B1 * 5/2001 Trout ..... 52/514.5

FOREIGN PATENT DOCUMENTS

| | | |
|---|---|---|
| AT | 0357736 | 12/1979 |
| DE | 8229583 | 3/1984 |
| FR | 1136651 | 12/1955 |

* cited by examiner

*Primary Examiner*—Beth A. Stephan
*Assistant Examiner*—Patrick J. Chavez
(74) *Attorney, Agent, or Firm*—Sidley Austin Brown & Wood, LLP

(57) ABSTRACT

An auxiliary tool for filling of an organic and/or inorganic mortar mass in a bore (B) and cooperating with an injection tool (D) connectable with a delivery tube (E) or a delivery hose, with the auxiliary tool (1, 6, 12) including a filling member (2; 7; 13) having an axial through-bore (3; 9; 17) through which the mortar mass (M) is injected into the bore (B), and an outer diameter selected so that a back flow of the mortar mass (M) in a direction toward a bore mouth is prevented, and an element for pinning the filling member (2; 7; 13) on a free end of the delivery tube (E) or the delivery hose.

10 Claims, 2 Drawing Sheets

AUXILIARY TOOL FOR FILLING A BORE WITH A MORTAR MASS

BACKGROUND OF THE INVENTION

1. Field of the Invention

Figure 1:
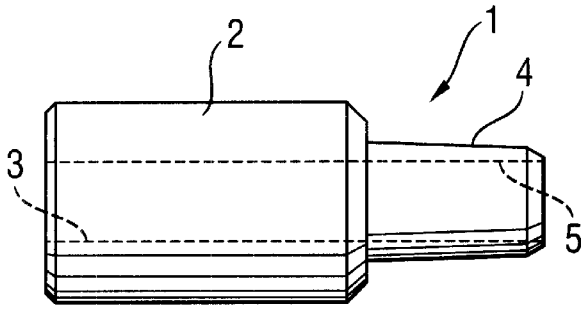

The present invention relates to an auxiliary tool for filling a bore which is formed, e.g., in a constructional component, with an organic and/or inorganic mortar mass.

2. Description of the Prior Art

In addition to force-and formlocking anchoring of fastening elements in bores, often, anchoring with a hardening organic and/or inorganic mortar mass is used. The anchoring of fastening elements with a hardening mass is used, e.g., when retaining of a predetermined distance between attachment points is of a critical importance and/or when the attachment points are located in regions of constructional components subjected to action of tensile forces. A further very important application of anchoring with a hardening organic or inorganic mortar mass is fitting of reinforced steel in concrete. This can become necessary, e.g., during a setting work, or for a subsequent reinforcement of—floors and ceilings, or for a subsequent attachment of components to the already finished constructions. Also, at a subsequent attachment or formation of overlapped junctions of reinforced metal in reinforced concrete constructions, the reinforced metal is secured by anchoring with the use of a hardening mass. To this end, a bore, which is formed in a constructional component is filled with a single-or multicomponent mortar mass formed on organic and/or inorganic basis. Then, the reinforced metal is inserted into the bore and becomes secured therein after the mortar mass hardens.

For filling the bores with a single-or multicomponent mortar mass, often, manually or mechanically driven injection tools are used. The filling of a bore starts from its bottom. In order to uniformally fill the bore, the operator of the injection tool should uniformally pull the injection tool out of the bore as the bore is being filled with the mass. However, the control of the progress of the bore filling is hardly possible. Anyway, such control can be effected only during filling of bores having a very small depth when the filling of the bore can be observed visually or, when manually driven tools are used, by counting the number of strokes. However, in particular when the reinforcement metal is inserted in an already formed constructional component, the respective bores have a relatively large depth. For filling such bores, injection tools have an extension pipe or an extension hose are used in order to be able to fill the bore from the bottom up. If during the filling of the bore with a mortar mass, the injection tool is pulled out too rapidly, air bubbles can be formed in the bore, and the bore would not be uniformly filled with a mortar mass. If the injection tool is not pulled sufficiently rapidly, the extension pipe or the extension hose becomes surrounded by the mortar mass. Upon pulling the pipe or the hose up, again, air bubbles can be formed. This can adversely affect the holding value of the mortar mass and influence negatively the attachment of the reinforcing steel.

Accordingly, an object of the present invention is to eliminate the drawbacks of the prior out and to so improve the technology of filling of bores with organic and/or inorganic mortar mass that uniform filling of a bore is achieved, and formation of air bubbles is prevented.

SUMMARY OF THE INVENTION

This and other objects of the present invention, which will become apparent hereinafter, are achieved by providing an auxiliary tool for filling of an organic and/or inorganic mortar mass in a bore and cooperating with an injection tool connectable with a delivery tube (or a delivery hose), and including a filling member which can be pinned on the free end of the delivery tube or a hose. The filling member has an axial through-bore through which the mortar mass is injected into the bore, and an outer diameter selected so that a back flow of the mortar mass in a direction toward a bore mouth is prevented. The filling member, which is pinned on the extension tube or hose, prevents backflow of the injected mortar mass. Thereby, during filling of the bore, a dynamic pressure or an ascending force is generated. With a rigid injection tube, this dynamic pressure or the ascending force is transmitted to the injection tool or the tool operator, and the injection tool is forcefully pressed away from the bore mouth. With a flexible injection hose, the filling member of the auxiliary tool is pushed toward the mortar mass upper surface and forces the extension hose, dependent on the progress of filling of the bore, toward the bore mouth. The filling member of the auxiliary tool is always located on the upper surface of the mortar mass. If, e.g., the extension tube is provided with some kind of marking on its circumference, an amount of the mortar mass, already in the bore, can be determined. The provision of a filling member, which is pinned on an extension tube or hose, insures a controlled filling of the bore from the bore bottom upward. The provision of the auxiliary tool according to the present invention prevents an incomplete filling of the bore and formation of air bubble. This enables the auxiliary tool operator to feel how the filling proceeds. Generally, the inventive auxiliary tool with a filling member permits to conduct filling in a rapid and controlled manner.

According to one embodiment of the invention, the filling member has a cylindrical shape. The length of the cylinder is so selected that jamming of the filling member in a bore because of the non-uniformity of the bore is prevented. Preferably, the length of the filling member is so selected that it corresponds to from about 1.5 times to about 3 times of the bore diameter.

The outer diameter of the cylindrical filling member corresponds to the bore diameter. Because of allowable deviations of the bore shape, size and roughness, advantageously, the outer diameter of the cylindrical filling member is smaller than the bore diameter by from about 1 mm to about 3 mm.

For connecting the auxiliary tool with the extension tube or hose, the filling member can be provided, e.g., with an insert-in bore. Preferably, the insert-in bore has a conical shape to compensate for the tolerances of the outer diameter of the extension tube or hose.

In accordance with a further embodiment of the present invention, the filling member is formed of several disc members having flexible rims which sealingly engage the bore wall. The outer diameter of the filling member measured at the flexible rims is larger than the bore diameter. This insures a complete sealing of the filling member with respect to the bore wall. The flexibility of the circumferential rims compensate the non-uniformity of the bore.

In accordance with another embodiment of the present invention, the filling member is connected with a cylindrically or conical connection journal insertable in a free end of the extension tube or hose. The connection journal has an axial bore that opens into the mouth of the filling member. The outer diameter of the connection journal is smaller than the outer diameter of the filling member. Advantageously, the connection journal has a conical outer contour that decreases toward its free end, whereby the tolerances of the extension tube or hose opening can be compensated.

For manufacturing reason and in order to facilitate handling of the auxiliary tool, advantageously, the filling member and the connection journal are formed as a one-piece part. In order to further facilitate the handling of the auxiliary tool, the filling member is formed of a plurability of concentrically arranged elements located one within another in a manner of onion skins and connected by connection webs separable at respective breakoff points. The breakoff point on the connection webs are provided in circumfential regions of a respective elements having a smaller outer diameter.

The foregoing measures prevent the connection web from projecting from the circumference of the filling member after removal of the outer filling section which otherwise could be interlocked with the bore formations. The formations of the filling member of several elements permits to provide an auxiliary tool that be used for filing of bores having different diameters. Thereby, the worker need not carry several auxiliary tools. Rather, after filling a first bore having a greater diameter, the worker can remove the outer element and use the same tool for another bore having a smaller diameter.

For manufacturing reasons and in order to keep the costs of the auxiliary tools down, at least the filling member is formed of a dimensionally stable plastic material. The connection journal can be formed of another material, e.g., metal. However, advantageously, the entire auxiliary tool is formed of the same material which favors mass production of the tool, e.g., by a simple injection molding.

The novel features of the present invention, which are considered as characteristic for the invention, are set forth in particular in the appended claims. The invention itself, however, both as to its construction and its mode of operation, together with additional advantageous and objects thereof, will be best understood from the following detailed description of preferred embodiments, when read with reference to the accompanying drawings.

Figure 2:
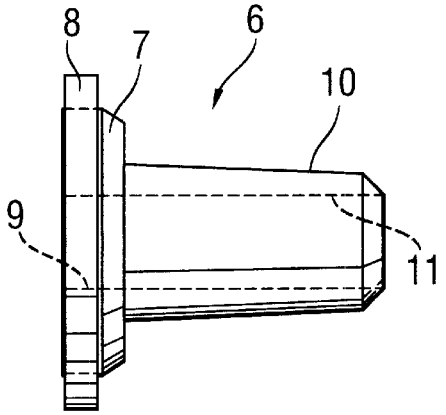
Figure 3:
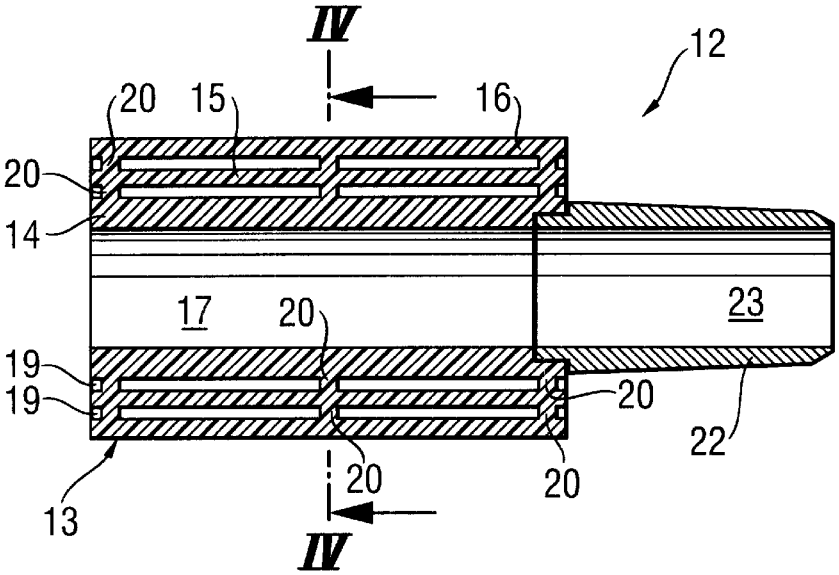
Figure 4:
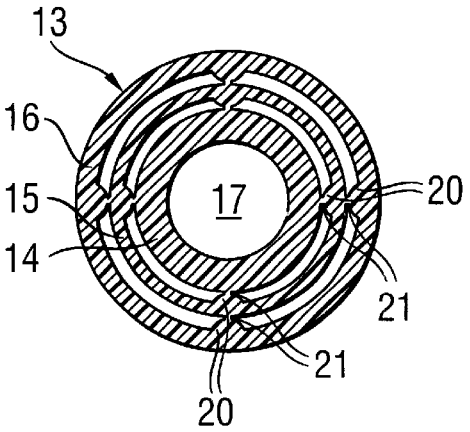
Figure 5:
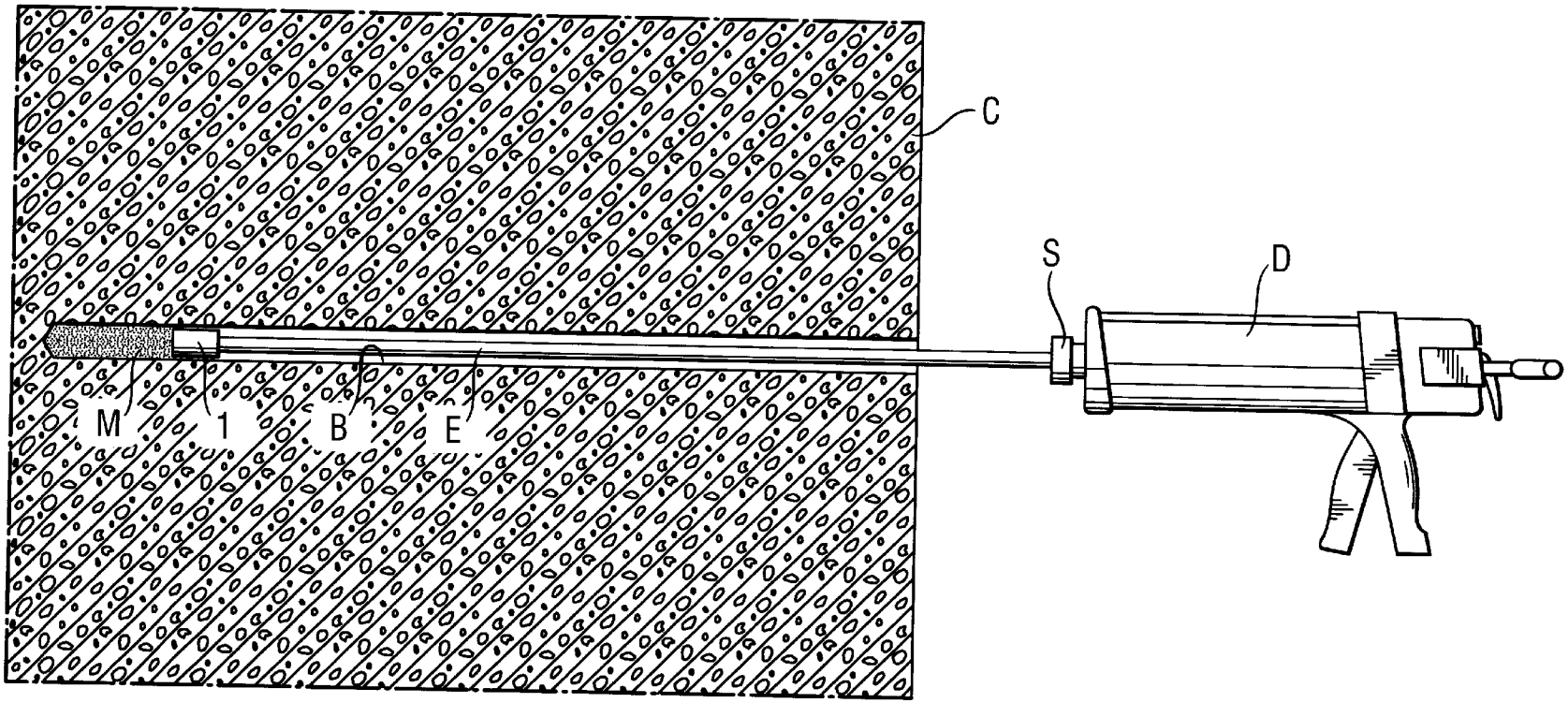

BRIEF DESCRIPTION OF THE DRAWINGS: The drawings show:

FIG. 1. a side view of a first embodiment of an auxiliary tool according to the present invention for filling in of a mortar mass in a bore;

FIG. 2. a side view of a second embodiment of an auxiliary tool according to the present invention for filling in of a mortar mass in a bore;

FIG. 3. a side cross-sectional view of a third embodiment of an auxiliary tool according to the present invention for filling in a mortar mass in a bore;

FIG. 4. a cross-sectional view of the auxiliary tool shown in FIG. 3 along line iv—iv; and FIG. 5 a view illustrating the use of an auxiliary tool according to the present invention.

DETAILED DESCRIPTION OF THE PREFERRED EMBODIMENTS

An auxiliary tool according to the present invention for filling of a mortar mass in a bore, which is shown in FIG. 1, is generally designated by a reference numeral 1. The tool 1 includes a filling member 2 having a through-bore 3 which is shown in FIG. 1 with dash lines. A connection journal 4 projects reawardly from the filling member 2. The connection journal 4 has likewise an axial bore 5 also shown with dash lines. The bore 5 opens into the bore 3 of the filling member 2. The filling member 2 has a greater diameter that the connection journal 4. The outer diameter of the filling member 2 is so selected that it corresponds substantially to the diameter of the to-be-filled bore and, is preferably, smaller of the diameter of the to-be-filled bore by from about 1 mm to about 3 mm. For use in concrete, usually, the diameter of the filling member 1 is selected in whole numbers. The outer profile of the connection journal 4 has a slightly conical shape so that the outer diameter of the connection journal diminishes toward its free end.

A second embodiment of an auxiliary tool according to the present invention for filling of a mortar mass in a bore, which is shown in FIG. 2, is generally designated with a reference numeral 6. The tool 6 includes a filling member 7 which has a shape of a disc and a through-bore 9. A flexible rim 8 is provided on the circumference of the disc-shaped filing member 7. The flexible rim 8 can be formed as a separate part and be permanently connected to the circumference of the filling member 7, e.g., by gluing. However, the flexible member 8 can be formed with the filling member 7 as a one-piece part. A connection journal 10 projects reawardly from the filling member 7 and has an axial bore 11. Advantageously, the outer profile of the connection journal 10 has a slightly conical shape. An auxiliary tool according to the present invention, which is shown in FIGS. 3–4 and is generally designated with a reference numeral 12, has an outer profile corresponding substantially to the profile of the auxiliary tool shown in FIG. 1. The auxiliary tool 12 shown in FIG. 3 differs from the auxiliary tool 1 shown in FIG. 1 in that the filling member is formed of a plurality of filling elements having different outer diameter and forming a single part. The filling member 13 of the auxiliary tool 12 shown in FIGS. 3–4 is formed of separate cylindrical filling elements 14, 15, 16 concentrically arranged one within the other in a manner of onion skins. The filling member 13 shown in FIGS. 3–4 includes an inner element 14, an intermediate element 15, and an outer element 16. The inner element 14 has a through-bore 17 and is arranged within the through-bore 18 of the intermediate element 15 which, in turn, is arranged within a through-bore 19 of the outer element 16. The outer diameter of the filling member 13 corresponds to the diameter of a to-be-filled bore and is usually smaller than the diameter of the to-be-filled bore by from 1 mm to 3 mm. The annual gap between adjacent filling elements 14, 15, 16 is sufficiently small to prevent a back flow of a relatively liquid mortar mass. The arranged within each other elements 14, 15, 16 are preferably connected with each other by respective connection webs 20. The connection webs 20 are uniformly distributed over the circumference and have break-off points 21 which are broken by rotating two adjacent elements in opposite directions. The break-off points 21 on the connection webs 20 are arranged always in a circumferential region of the elements 14 and 15 with a smaller outer diameter. After the webs 20 are separated at the break-off points 21, the respective outermost element is pulled off so that a filling member with a necessary diameter is obtained. A connection journal 22 projects reawardly from the inner element 14 and has an axial bore 23 that opens into the central through-bore 17 of the inner element 14. The outer profile of the connection journal 22 has, preferably, a slightly conical shape.

FIG. 5 shows an example of the use of an auxiliary tool according to the present invention and, specifically, the use of the auxiliary tool 1 shown in FIG. 1, for filling a bore with an organic or inorganic mortar mass. In FIG. 5, the injection tool is designated with a reference character D. A mortar mass, which is located inside a sheath, is injected into a bore with the injection tool D. At the outlet side of the injection tool D, there is provided a mixing tube S connected with the injection tool D. Inside the mixing tube S, there is located, e.g., a static mixer used, e.g., for mixing of a two-or-three component mortar mass. The mixing tube S is connected with a delivery tube E which provides for filling in of bores having a large depth as is required, e.g., for a subsequent fixing-in of reinforcing metal. The concrete block is designated with a reference character C, and the bore is designated with a reference character B. The delivery tube E extends into the bore B. The auxiliary tool 1 is pinned on the free end of the delivery tube E. The mortar mass M is injected into the bore B with the injection tool D through the mixing tube S, the delivery tube E, and the auxiliary tool 1. The filling-in of the bore B is effected, as required, from the bottom up. The auxiliary tool 1 prevents back flow of the motar mass toward the mouth of the bore B. Thereby, upon filing-in of the bore B. an impact pressure is generated that through the auxiliary tool 1, the delivery tube E, and the mixing tube S, moves the injection tool D away from the mouth of the bore B. Thereby, the bore B is uniformly filled in with a mortar mass M without any air bubbles. The impact pressure, which is generated upon filling the bore B with a mortar mass, is immediately traced to an operator so that the operator can feel how the bore B is being filled in.

While FIG. 5 shows that the delivery tube E is connected with a separate auxiliary tool, the auxiliary tool, of course, can be formed integrally with a delivery tube. The auxiliary tool can be formed of a formstable plastic material and can be produced advantageously, in a mass production, e.g., by injection molding.

Though the present invention was shown and described with references to the preferred embodiments, such are merely illustrative of the present invention and are not to be construed as a limitation thereof and various modifications of the present invention will be apparent to those skilled in the art. It is, therefore not, intended that the present invention be limited to the disclosed embodiments or details thereof, and the present invention includes all variations and/or alternatives embodiments within the spirit and scope of the present invention as defined by the appended claims.

What is claimed is:

1. An auxiliary tool for filling of at least one of an organic and inorganic mortar mass in a bore (B) and cooperating with an injection tool (D) connectable with one of a delivery tube (E) and a delivery hose, the auxiliary tool (1, 6, 12) comprising of a filling member (2; 7; 13) having an axial through-bore (3; 9; 17) through which the mortar mass (M) is injected into the bore (B), and a continuous circumferential surface an outer diameter of which is selected so that a back flow of the mortar mass (M) in a direction toward a bore mouth is prevented; and means for pinning the filling member (2; 7; 13) on a free end of the one of the delivery tube (E) and the delivery hose.

2. An auxiliary tool according to claim 1, wherein the filling member (2; 13) has a shape of a cylinder a length of which amounts to from about 1.5 times to about 3 times of a diameter of the bore (B).

3. An auxiliary tool according to claim 2, wherein the outer diameter of the filling element (2; 13) is smaller than the bore diameter by from about 1 mm to about 3 mm.

4. An auxiliary tool according to claim 1, wherein the filling member (7) is formed of at least one disc member having a flexible rim that sealingly engages a wall of the bore (B).

5. An auxiliary tool according to claim 1, wherein the pinning-on means comprises a connection journal (4; 10; 22) connected with the filling member (2; 7; 13), having a smaller diameter than the diameter of the filling member (2; 7; 13) and having an axial bore (5; 11; 23) that opens into the through-bore (3; 9; 17) of the filling member (2; 7; 13).

6. An auxiliary tool according to claim 5, wherein the connection journal (4; 10; 22) has a conical shape.

7. An auxiliary tool according to claim 5, wherein the connection journal (4; 10; 22) is formed with the filling member (2; 7; 13) as a one-piece part.

8. An auxiliary tool according to claim 1, wherein the filling member (2; 7; 13) is formed of a dimensionally plastic material.

9. An auxiliary tool for filling of at least one of an organic and inorganic mortar mass in a bore (B) and cooperating with an injection tool (D) connectable with one of a delivery tube (E) and a delivery hose, the auxiliary tool (1, 6, 12) comprising of a filling member (2; 7; 13) having an axial through-bore (3; 9; 17) through which the mortar mass (M) is injected into the bore (B), and an outer diameter selected so that a back flow of the mortar mass (M) in a direction toward a bore mouth is prevented; and means for pinning the filling member (2; 7; 13) on a free end of the one of the delivery tube (E) and the delivery hose, wherein the filling member (13) is formed of a plurality of concentrically arranged elements (14, 15, 16) located one within another in a manner of onion skins and connected by connection webs (2) separable at respective break-off points (21).

10. An auxiliary tool according to claim 9, wherein the break-off points (21) on the connection webs (20) are provided in circumferential region of a respective elements (14, 15) having a smaller outer diameter.

* * * * *